US010995921B2

(12) United States Patent
He et al.

(10) Patent No.: US 10,995,921 B2
(45) Date of Patent: May 4, 2021

(54) FLAME SIMULATING DEVICE AND SIMULATED ELECTRIC FIREPLACE

(71) Applicant: JIANGMEN KEYE ELECTRIC APPLIANCES MANUFACTURING CO., LTD, Jiangmen (CN)

(72) Inventors: Xiangming He, Jiangmen (CN); Guanglian Lin, Jiangmen (CN)

(73) Assignee: JIANGMEN KEYE ELECTRIC APPLIANCES MANUFACTURING CO., LTD, Jiangmen (CN)

( * ) Notice: Subject to any disclaimer, the term of this patent is extended or adjusted under 35 U.S.C. 154(b) by 0 days.

(21) Appl. No.: 16/804,773

(22) Filed: Feb. 28, 2020

(65) Prior Publication Data

US 2020/0370722 A1 Nov. 26, 2020

(30) Foreign Application Priority Data

May 22, 2019 (CN) ..... 201910429735.9
Jan. 23, 2020 (CN) ..... 202010076465.0

(51) Int. Cl.

| | |
|---|---|
| ***F21S 10/04*** | (2006.01) |
| ***F21S 4/28*** | (2016.01) |
| *F21Y 115/10* | (2016.01) |
| *F21W 121/00* | (2006.01) |

(52) U.S. Cl.

CPC ..... *F21S 10/046* (2013.01); *F21S 4/28* (2016.01); *F21W 2121/00* (2013.01); *F21Y 2115/10* (2016.08)

(58) Field of Classification Search

CPC ..... F21S 10/043; F21S 10/04; F21S 10/046; F21S 4/28; F21Y 2115/10; F21W 2121/00; A63J 5/023; F24C 7/004

See application file for complete search history.

(56) References Cited

U.S. PATENT DOCUMENTS

| | | | | |
|---|---|---|---|---|
| 7,236,693 | B2 | 6/2007 | Haugom | |
| 8,412,028 | B2 * | 4/2013 | Zhu | F24C 7/004 392/348 |
| 8,671,600 | B2 * | 3/2014 | Lu | F21S 10/046 40/428 |
| 8,904,681 | B2 | 12/2014 | Pan | |
| 10,371,333 | B2 * | 8/2019 | Jones | F24B 1/1808 |

FOREIGN PATENT DOCUMENTS

| | | | |
|---|---|---|---|
| CN | 201680279 | U | 12/2010 |
| CN | 202511185 | U | 10/2012 |
| CN | 102980132 | A | 3/2013 |

(Continued)

*Primary Examiner* — Cassandra Davis

(74) *Attorney, Agent, or Firm* — Schmeiser, Olsen & Watts, LLP

(57) ABSTRACT

Provided is a flame simulating device including a light source, at least one light-transmitting rotator and an imaging plate, and the light source emits a first light group; the light-transmitting rotators are arranged in a light path of the first light group in a rotatable manner, each of the light-transmitting rotators is provided with multiple light concentrating blocks, these multiple light concentrating blocks convert the first light group into a second light group; and the imaging plate is fixedly arranged in a light path of the second light group.

17 Claims, 7 Drawing Sheets

(56) References Cited

FOREIGN PATENT DOCUMENTS

| | | | | | |
|---|---|---|---|---|---|
| CN | 203036751 | U | | 7/2013 | |
| CN | 203628512 | U | | 6/2014 | |
| CN | 205536076 | U | | 8/2016 | |
| CN | 205536077 | U | | 8/2016 | |
| CN | 205747107 | U | | 11/2016 | |
| CN | 206037209 | U | | 3/2017 | |
| CN | 206222233 | U | | 6/2017 | |
| CN | 206545962 | U | | 10/2017 | |
| CN | 207230707 | U | | 4/2018 | |
| DE | 102004016156 | A1 | * | 11/2005 | ..... F24C 7/004 |
| GB | 2267563 | A | * | 12/1993 | ..... F24C 7/004 |
| WO | WO-2014139191 | A1 | * | 9/2014 | ..... F24C 7/004 |

* cited by examiner

FLAME SIMULATING DEVICE AND SIMULATED ELECTRIC FIREPLACE

CROSS-REFERENCE TO RELATED APPLICATIONS

This application claims priority to Chinese Application No. CN201910429735.9, having a filing date of May 22, 2019, and Chinese Application No. CN202010076465.0, having a filing date of Jan. 23, 2020, the entire contents of which are hereby incorporated by reference.

FIELD OF TECHNOLOGY

The following relates to the field of simulated electric fireplaces, in particular to a flame simulating device which can simulate fluttering flames and a simulated electric fireplace.

BACKGROUND

As decorative equipment which integrates modern optical principles, the simulated electric fireplace has more outstanding decorative effects and is spread most widely. With electric energy as its energy source, the simulated electric fireplace is provided with no open flame, and two-dimensional or three-dimensional flames are generated relying on reflection of lights, then matched with simulation charcoal, a visual effect of simulating flame combustion is generated.

In the conventional art, as to a traditional practice of a simulated electric fireplace, a light source is arranged at a bottom part of a side wall of simulated fuels, so as to irradiate simulated fuels, and enable to generate a visual effect of combustion. In order that the effect of simulated fuels is vivid, generally, a light-reflecting component which is provided with multiple irregular light-reflecting blades is provided. The light-reflecting component is arranged on a synchronous motor, and along with the rotation of the synchronous motor, a light source irradiates onto the rotating light-reflecting blades, and then is reflected to a flame imaging screen to show an effect of flame combustion.

SUMMARY

An aspect relates to flame simulating devices and simulated electric fireplaces installed with any one of the above flame simulating devices.

In some embodiment, a flame simulating device includes a light source, at least one light-transmitting rotator and an imaging plate, and the light source emits a first light group; the light-transmitting rotators are arranged in the light path of the first light group in a rotatable manner, each of the light-transmitting rotators is provided with light concentrating blocks, the light concentrating blocks convert the first light group into a second light group; and the imaging plate is arranged in the light path of the second light group.

In some embodiments, each of the light-transmitting rotators is a hollow sphere; some of the light concentrating blocks are closely arranged to be in circle along a circumferential direction of the hollow sphere, and the circles of light concentrating blocks are closely arranged along an axial direction of the hollow sphere. Since the light-transmitting rotator is a hollow sphere, the surface of the hollow surface is a curved surface, the angle of each light concentrating block adhered onto the hollow sphere is different, and the distance between the light emitted by a light source and each light concentrating block is different, such that the angle change of the second light group formed through refraction is more various, and finally, the second light group irradiates onto the imaging plate to form light spots which change more irregularly in positions.

In some embodiments, the number of the light-transmitting rotators is at least two, the light-transmitting rotators are arranged coaxially and alternately, and each two light-transmitting rotators are connected via a connector, the connectors are opaque. Through the setting of the opaque connector, mutual interference between lights which penetrate through each light-transmitting rotator can be avoided.

In some embodiments, each of the light-transmitting rotators is a cylinder; some of the light concentrating blocks are closely arranged to be in a circle along the circumferential direction of the light-transmitting rotators, and the circles of light concentrating blocks are closely arranged along the axial direction of the light-transmitting rotators.

In some embodiments, a light blocking plate is arranged between each two adjacent circles of light concentrating blocks.

In some embodiments, the light source includes at least one LED array, each of the LED arrays is formed by several LED lights, and the LED lights are arranged in a row equidistantly; each of the LED arrays is arranged along the axial direction of the light-transmitting rotators, and is arranged in front of one of the light-transmitting rotators.

In some embodiments, the number of the light-transmitting rotators is three, and the LED array corresponding to the light-transmitting rotator in the middle includes blue LED lights and orange LED lights.

In some embodiments, the flame simulating device includes a flame plate, the flame plate is provided with light-transmitting holes, and is arranged in the light path of the second light group between the light-transmitting rotators and the imaging plate; the second light group emitted from the light-transmitting rotators and projects on the imaging plate through the light transmitting hole of the flame plate.

In some embodiments, the flame simulating device includes a motor, the motor drives the light-transmitting rotator to rotate.

In an embodiment, a simulated electric fireplace includes a shell, the front side of the shell is provided with a window, wherein the inner cavity of the shell is provided with one of the flame simulating devices above.

In an embodiments, a flame simulating device includes a light source, rotatable light-transmitting means or rotatable light-transmitter and an imaging plate, and the light source emits a first light group; the first light group passes through the light-transmitting means or light-transmitter and forms a second light group, the second light group projects on the imaging plate and forms images.

In some embodiments, each of the light-transmitting means or light-transmitter includes several light mixing blocks, the first light group passes through the light-transmitting means or light-transmitter and the light mixing blocks then forms the second light group.

In some embodiments, the light mixing blocks include convex lenses.

In some embodiments, the light mixing blocks include concave lenses.

In some embodiments, the light mixing blocks include convex lenses and concave lenses.

In some embodiments, the light-transmitting means or light-transmitter are cylinders.

In some embodiments, the light-transmitting means or light-transmitter are rotators, the bus of each rotator is an arc, and the shape of each rotator is formed by rotating the bus around an axis.

In some embodiments, the flame simulating device comprises at least two light-transmitting means or light-transmitters which are arranged coaxially, and each two light-transmitting means or light-transmitter are connected via a connector, the axis of the light-transmitting means or light-transmitter penetrate the connector, the light-transmitting means or light-transmitter and the connectors can rotate around the axis.

In some embodiments, the light-transmitting means or light-transmitter are hollow, the light mixing blocks are arranged at the inner or outer surfaces of the light-transmitting means or light-transmitter; or the light-transmitting means or light-transmitter are solid, the light mixing blocks are arranged at the outer surfaces of the light-transmitting means or light-transmitter.

In some embodiments, some of the light mixing blocks are closely arranged to be in a circle along a circumferential direction of the light-transmitting means or light-transmitter, and the circles of light concentrating blocks are closely arranged along the axial direction of the light-transmitting means or light-transmitter.

In some embodiments, the light source includes at least one LED array, each of the LED arrays is formed by several LED lights, and the LED lights are arranged in a row equidistantly; each of the LED arrays is arranged along the axial direction of the light-transmitting rotators, and is arranged in front of one of the light-transmitting rotators.

In some embodiments, the flame simulating device includes a motor, the motor drives the light-transmitting means or light-transmitter to rotate.

BRIEF DESCRIPTION OF THE DRAWINGS

Some of the embodiments will be described in detail, with reference to the following figures, wherein like designations denote like members, wherein.

Figure 1:
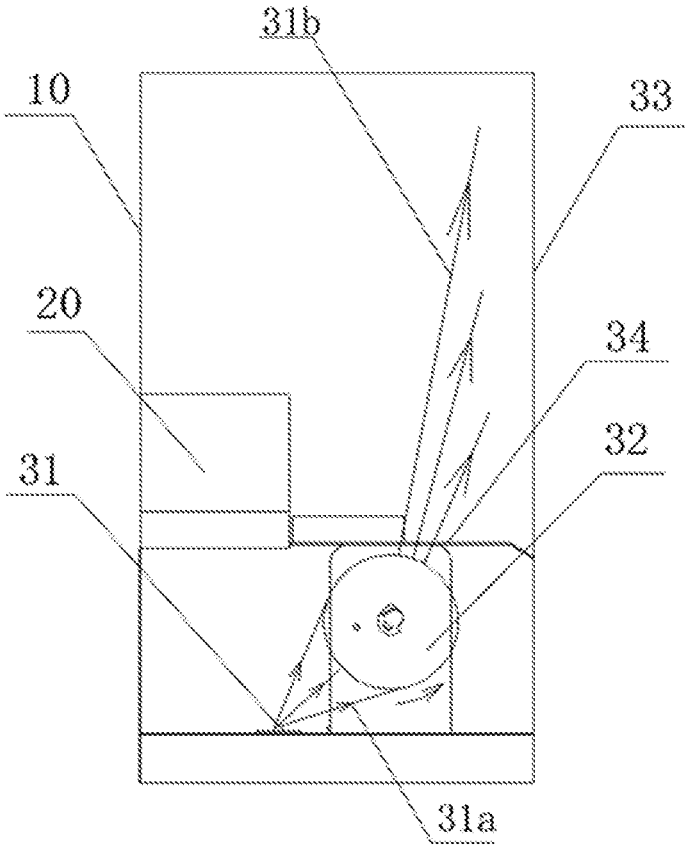
FIG. 1 is an overall structural schematic diagram of a simulated electric fireplace of embodiment 1.

Reference numerals in the figures: 10—shell; 20—simulated fuel; 31—light source; 31*a*—first light group; 31*b*—second light group; 32—light-transmitting rotator; 33—imaging plate; 33*a*—light-transmitting plate; 34—flame plate; 35—hollow cylinder; 311—strip circuit board; 321—light concentrating block; 321*a*—lense group; 322—support frame; 323—motor; 324—opaque connector; 341—light-transmitting hole; 342—light blocking piece; 351—cover body; 352—axle sleeve; 353—light blocking plate; C—the connector of two convex lenses; D—the connector of two concave lenses; F—focus; a1, a2—convex lens; b1, b2—light spots.

DETAIL DESCRIPTION

For a better understanding and implementation, embodiments of the present invention will be described in detail below in combination with accompanying drawings.

Embodiment 1

Figure 2:
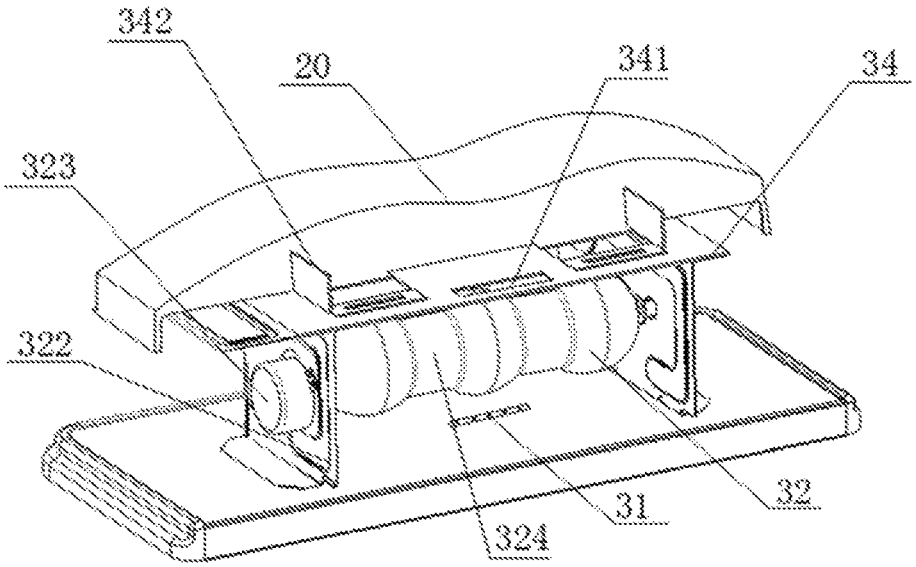
FIG. 2 is a partial structural schematic diagram of a simulated electric fireplace of embodiment 1.

Please refer to FIG. 1 and FIG. 2 simultaneously. A simulated electric fireplace of the present embodiment includes a shell 10 and simulated fuels 20 arranged in the shell 10 and a flame simulating device, wherein the front side face of the shell 10 is provided with a window communicated with an inner cavity of the shell 10, and the inner cavity of the shell 10 is provided with the flame simulating device.

The flame simulating device includes a light source 31, light-transmitting rotators 32 and an imaging plate 33 arranged in the same light path, wherein the light source 31 emits a first light group 31*a* after being energized; the light-transmitting rotators 32 are arranged in a light path of the first light group 31*a* in a rotatable manner, each of the light-transmitting rotators 32 is provided with light concentrating blocks 321, these multiple light concentrating blocks 321 convert the first light group 31*a* into a second light group 31*b*; and the imaging plate 33 is fixedly arranged in a light path of the second light group 31*b*. In some embodiments, each rotator 32 can be a rotating body, that is, a geometry which is formed by a closed curved surface, wherein the closed curved surface is formed by a curve in a plane rotating around an axis in the same plane, and the curve is called the bus of the rotator. Meanwhile, in some embodiments, each rotator 32 can be an asymmetric rotatable geometry.

In some embodiments, the flame simulating device includes three light-transmitting rotators 32. The three light-transmitting rotators 32 are arranged on the same axis and are molded as a rotating body, wherein each two adjacent light-transmitting rotators 32 are connected through an opaque connector 324, that is, the three light-transmitting rotators 32 are molded to the rotating body through two opaque connectors 324. In some embodiments, each of the opaque connectors 324 is a cylinder with a diameter being slightly smaller than the diameter of the hollow sphere, a frosted surface is arranged on the surface of the cylinder, and the frosted surface functions to reduce mutual interference between lights which pass through each light-transmitting rotator 32. Two ends of the rotating body are installed on a bottom plate of the shell 10 through two oppositely arranged support frames 322, in some embodiments, rotating axes exposed outside two ends of the rotating body are respectively arranged on two support frames 322 in a hinged and penetrating manner, a motor 323 is arranged outside one of the support frames 322, an axle sleeve is arranged on a rotating axis at one end of the rotating body, and is sleeved on a rotating axis of the motor 323 through the axle sleeve, such that the rotating body rotates between two support frames 322 along with the motor 323.

Figure 3:
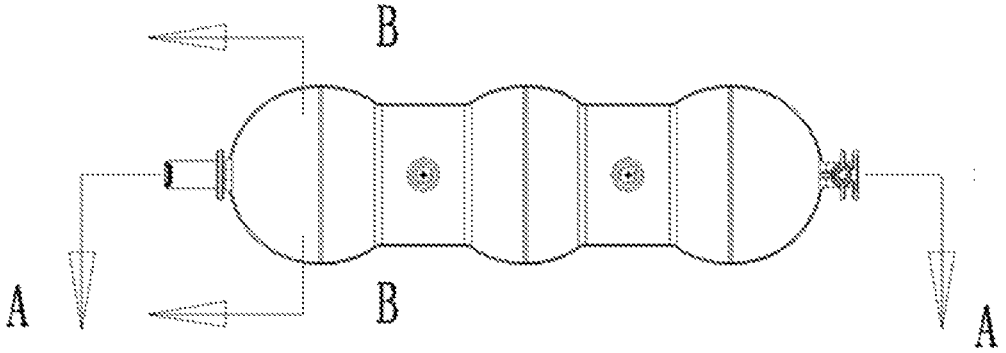
FIG. 3 is a structure chart of a light-transmitting rotator of embodiment 1.
Figure 4:
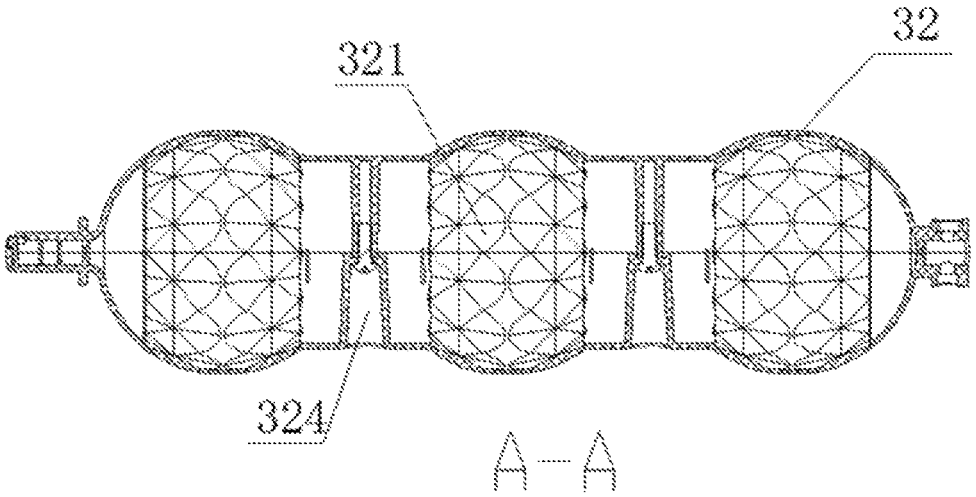
FIG. 4 is a sectional view of direction A-A of a light-transmitting rotator of FIG. 3.
Figure 5:
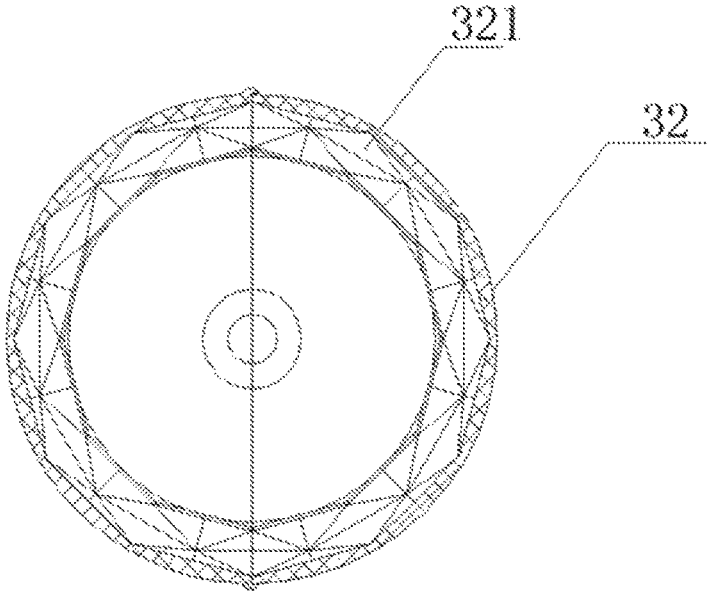
FIG. 5 is a sectional view of direction B-B of a light-transmitting rotator of FIG. 3.

In some embodiments, each of the light-transmitting rotators 32 is a hollow cambered shell 10, please refer to FIG. 3, FIG. 4 and FIG. 5 simultaneously, each of the light-transmitting rotators 32 is a hollow sphere, and each bus of the light-transmitting rotators 32 is a single peak curve, and is made of transparent materials. In some embodiments, the hollow sphere is processed from rigid transparent plastics, such as polymethacrylate and other materials. In some embodiments, the light-transmitting rotator 32 is provided with multiple light concentrating blocks 321. It should be noted that, the light concentrating blocks 321 can be arranged on an outer surface of the light-transmitting rotator 32, and can also be arranged on an inner surface of the light-transmitting rotator 32, wherein the principles both utilize refraction and light condensing effects of a convex lens to convert the first light group into the second light group. The light concentrating blocks 321 are arranged on an inner surface of the light-transmitting rotator 32. In some embodiments, each of the light concentrating blocks 321 is a convex lens. The convex lenses are thick in the middle and thin in the edge, and the convex lenses can be any one kind or the mixture of a double convex, convex-plane and straight meniscus; and the shape of the convex lenses can be any one kind of a triangle, circle, semicircle, oval and rhombus. Some convex lenses are closely arranged to be a circle along a circumferential direction of the hollow sphere, and the circles of light concentrating blocks are arranged closely along an axial direction of the hollow sphere. In some embodiments, the convex lenses are meniscus lenses with various shapes, and each concave surface of the meniscus lenses is molded with an inner surface of the light-transmitting rotator 32, such that the protruding parts of the convex lenses are towards the inward, while the outer surfaces of the light-transmitting rotator 32 are of a smooth state.

In some embodiments, the simulated fuels 20 are set to be close to the window, and are simulation charcoal, in some embodiments multiple simulation charcoals are piled, and incline towards an inner cavity. The simulation charcoal is manufactured from light-transmitting resin and is ash black. The rotating body is arranged in the rear of the simulated fuel 20 and is lower than the simulated fuels 20 in height. When the inner cavity of the shell 10 is seen horizontally from the window, the simulated fuels 20 can be seen while the rotating body cannot be seen.

In some embodiments, the light source 31 includes three strip circuit boards 311, and each of the strip circuit boards 311 are provided with, along a length direction, at least one row of LED light groups formed by multiple LED lights which are distributed at equal intervals. Each of the light-transmitting rotators 32 is corresponding to one strip circuit board 311, and each strip circuit board 311 is in parallel with an axis of the rotating body. One of the strip circuit board 311 corresponds to the light-transmitting rotator 32 arranged in the middle, this strip circuit board is located on the same plane with the axis of the rotating body, and the plane is vertical to the ground, that is, the strip circuit board 311 is located just below the light-transmitting rotator 32 arranged in the middle, and the LED lights thereon at least include blue LED lights and red orange LED lights. The lights emitted by an LED light group on the strip circuit board 311 irradiate simultaneously on the bottom of the simulated fuels 20 and the imaging plate 23 through a second light group 31*b* converted by the light-transmitting rotator 32 located in the middle. Since the simulated fuels 20 are made of light-transmitting resin, when the simulated fuels 20 are seen from a window, lights which are flicking on the simulation charcoal can be observed, thereby simulating a flickering effect during combustion of the charcoal. In addition, two strip circuit boards 311, which correspond to two light-transmitting rotators 32 at two ends, are located at one side of the light-transmitting rotator 32, such that most of the lights emitted by an LED light group arranged on the strip circuit boards irradiate on an imaging plate 33 through a second light group 31*b* converted by two light-transmitting rotators 32 at two ends. In some embodiments, a flame plate 34 is arranged on the top part of the rotating body, one end of the flame plate 34 is connected with an imaging plate, while the other end is fixed with an inner side of the simulated fuels, and therefore, the flame plate 34 is erected on the top part of the rotating body and does not rotate along with the rotating body. The flame plate 34 is provided with multiple light-transmitting holes 341, the light-transmitting holes 341 are of flame shape. The second light group 31*b* irradiates onto the simulated fuels 20 and the imaging plate 33. Through setting size and position of the light-transmitting hole 341, the position where the second light group 31*b* irradiates onto, can be adjusted. It should be noted that, since two sides of the shell 10 are hollow, lights in the second light group 31*b* will irradiate to the outside of the shell through the two hollow sides. In order to prevent influencing use of a user due to irradiation of lights, in the present embodiment, at least two light blocking pieces 342 which are protruding and vertical to the flame plate are arranged close to hollow positions of the shell at two sides.

In some embodiments, the imaging plate 33 is a rear shell plate of the shell 10, and the rear shell plate is arranged in the rear of the rotating body. In some embodiments, the rear shell plate is posted with wallpaper with brick stripes. When the rear shell plate is directly used as an imaging plate 33, the manufacturing cost can be reduced.

Figure 6:
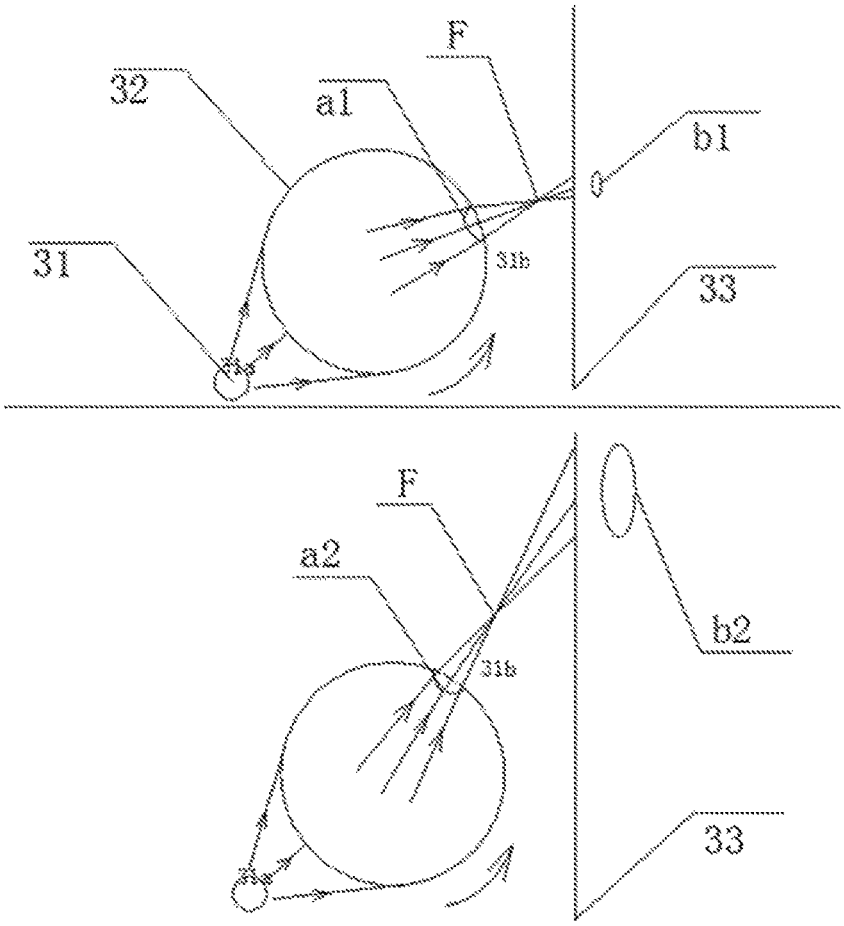
FIG. 6 is a first working principle diagram of a light-transmitting rotator of embodiment 1.
Figure 7:
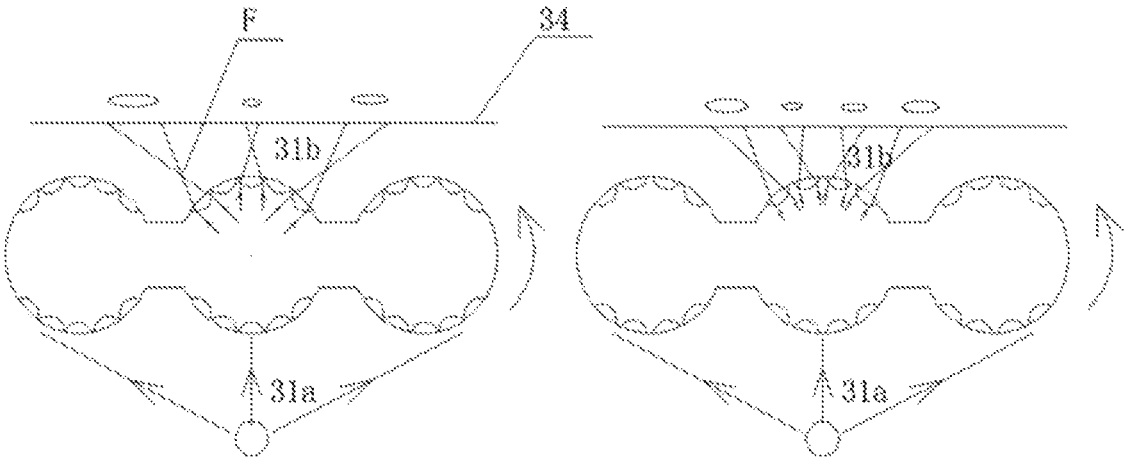
FIG. 7 is a second working principle diagram of a light-transmitting rotator of embodiment 1.

On the surface of each light-transmitting rotator 32, some of the light concentrating blocks 321 are arranged closely in a circle along the circumferential direction of the light-transmitting rotator 32, and the circles of the light concentrating blocks are closely arranged along the axial direction of the light-transmitting rotator 32. After being emitted by an LED light, the first light group 31*a* reflects and/or refracts for several times in one of the light-transmitting rotators 32, then the first light group 31*a* penetrates twice through the convex lenses on the inner surface of the light-transmitting rotator 32, and finally the first light group 31*a* emits from the light-transmitting rotator to form a second light group 31*b*. In this process, please refer to FIG. 6, a maximum cross section, vertical to an axial direction, of the light-transmitting rotator 32 is taken to describe the principle for generating flames on a vertical direction. On a vertical direction, the first light group 31*a* emitted by an LED light is a diverging light, the light firstly penetrates through multiple convex lenses which are arranged on a side of the light-transmitting rotator 32 and then enters into the light-transmitting rotator, and lights of the first light group 31*a* are converged under the refraction effect of the convex lenses. Afterwards, the light in the light-transmitting rotator 32 respectively passes through different convex lenses (a1, a2) on the light-transmitting rotator 32 and emits out. Since the light-transmitting rotator 32 is of a spherical surface, the distance between the center of the convex lens a1 and the rear imaging plate 33 is different from the distance between the center of the convex lens a2 and the rear imaging plate 33. Therefore, the distance between a focus F of the convex lens a1 and the rear imaging plate 33 is also different from the distance between the focus F of the convex lens a2 and the rear imaging plate 33. When the distance between the center of the convex lens a1 and the rear imaging plate 33 is smaller than the distance between the center of the convex lens a2 and the rear imaging plate 33, a part of the second light group 31*b* is formed after the light passes through the convex lens a1, and the part of the second light group 31*b* is focused and then continuously spread along a light path. Since the focus F of the convex lens a1 is near the rear imaging plate, when the light irradiates onto the imaging plate, clustered and bright light spots b1 are formed, and the size of the light spot b1 is relatively small. The other part of second light group 31*b* is formed after the light passes through the convex lens a2, since the focus F of the convex lens a2 is relatively far away from the rear imaging plate, when the light irradiates onto the imaging plate, diverged and gloomy light spots b2 are formed, and the size of the light spot b2 is relatively large. Therefore, the light spot b2 and the light spot b1, which are formed along the longitudinal direction of the imaging plate 33, are different in their shapes, positions and brightness. Similarly, on a horizontal direction, please refer to FIG. 7, two cross sections, in parallel with an axis, of the light-transmitting rotator 32 are taken to describe the principle for generating flames on a horizontal direction. Multiple convex lenses are distributed on a horizontal cross section of the light-transmitting rotator 32, and due to the shape setting of the convex lenses, the number of convex lenses on different cross sections will slightly differ. However, the core principle is based on the fact that the distance between the center of each convex lens and the rear imaging plate is different, which leads to different distances between the focus and the imaging plate, thereby generating light spots of different sizes and brightness. Therefore, it can be seen that, since multiple convex lenses are closely arranged on an inner surface of the light-transmitting rotator, the distance between each convex lens and the imaging plate is different, therefore, the shapes and brightness of the light spots formed when the generated multiple second light groups 31*b* irradiate on the imaging plate are also different. Meanwhile, since the light-transmitting rotator rotates along with a motor, and along with the change of rotating angles, the light spots will be changed in positions. The light spots are of different brightness and shapes and are formed along the horizontal direction of the imaging plate 33. Therefore, an effect that sparkles flutter upward can be observed, and it is capable for simulating the effect of fading, flaring and fluttering of flames.

When using, a first light group 31*a* emitted by the light source irradiates on a light-transmitting rotator which rotates along with a motor, penetrates twice through the convex lenses on the light-transmitting rotator to form a second light group 31*b* with changed angles, and finally projects to the rear shell plate to form light spots. Since the angle of each convex lens and the distance between each convex lens and the rear shell plate are different, the formed light spots are changed in shapes, brightness and positions, thereby showing an effect of flame fading and flaring and sparkle fluttering on the rear shell plate, and improving sense of reality and three-dimensional sense of combustion of simulated fuels.

Embodiment 2

The main structure of the simulated electric fireplace in the embodiment 2 is the same as the structure in embodiment 1, and the simulated electric fireplace in the embodiment 2 merely differs in the structures of the light-transmitting rotators.

Figure 8:
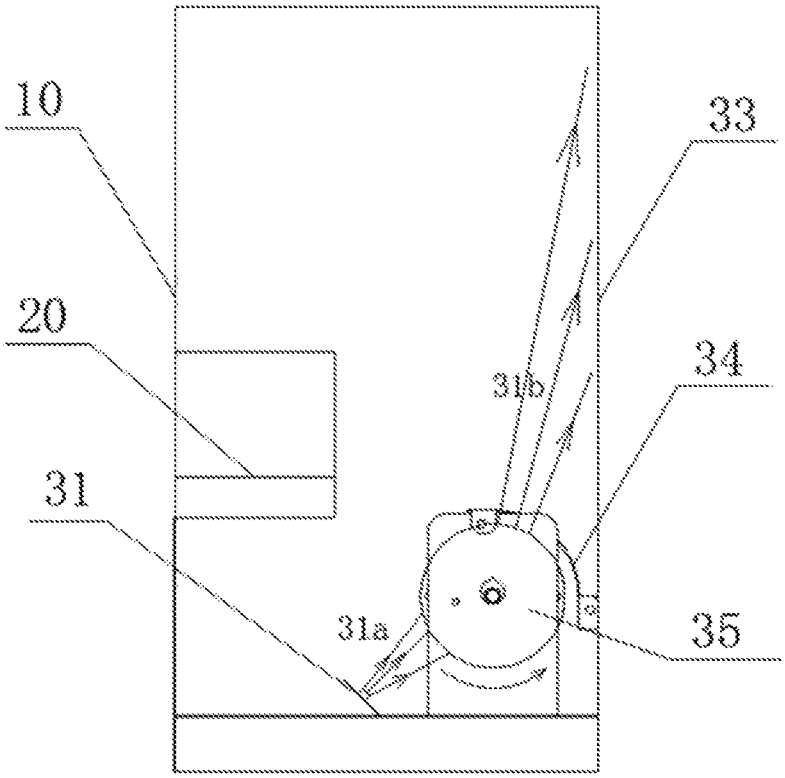
FIG. 8 is an overall structural schematic diagram of a simulated electric fireplace of embodiment 2.
Figure 9:
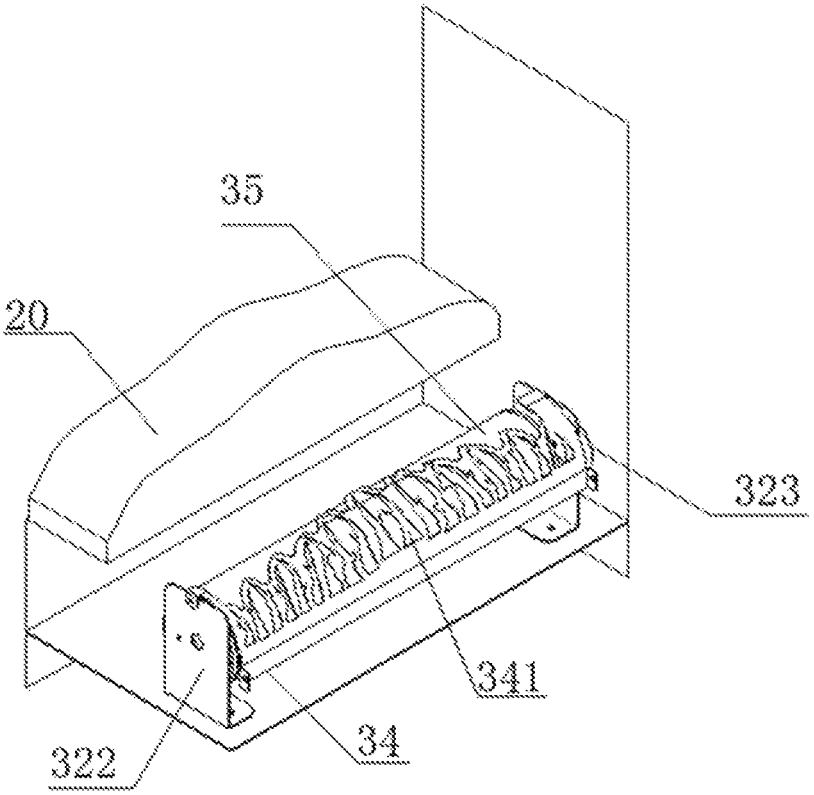
FIG. 9 is a partial structural schematic diagram of a simulated electric fireplace of embodiment 2.
Figure 10:
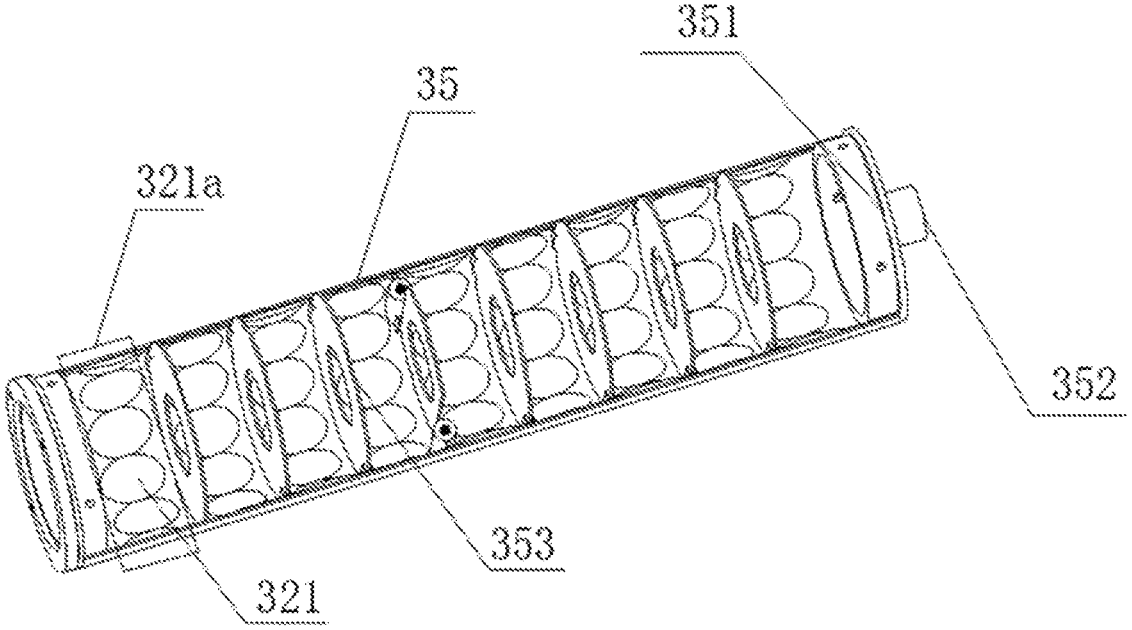
FIG. 10 is a structure chart of a light-transmitting rotator of embodiment 2.

In the embodiment 2, please refer to FIG. 8, FIG. 9 and FIG. 10 simultaneously. Each of the light-transmitting rotators is a hollow cylinder 35 with a bus being a linear segment. In some embodiments, the cylinder body of the hollow cylinder 35 is made of rigid transparent materials. Two ends of the hollow cylinder 35 are respectively sleeved with two cover bodies 351. A rotating axis is arranged in the outer center of each cover body, and an axle sleeve 352 is arranged on the rotating axis of one of the cover bodies. The two rotating axes of two cover bodies 351 are respectively arranged to penetrate the two support frames 322 in a rotatable manner. And the two rotating axes are connected with the motor 323 on one of the support frames 322 via the axle sleeve 352, such that the hollow cylinder 35 can rotate between two support frames 322.

In some embodiments, an inner surface of the hollow cylinder 35 is provided with multiple light concentrating blocks 321, the light concentrating blocks 321 are convex lenses. And in some embodiments, the convex lenses are oval meniscus lenses, and a concave surface of each meniscus lens is adhered onto an inner surface of the hollow cylinder 35 through a molding manner, such that the protruding part faces inwards. Some of the light concentrating blocks 321 are closely arranged to be in a circle along the circumferential direction of the hollow cylinder 35 to form a lens group 321*a*, and the circles of light concentrating blocks are arranged at equal intervals along the axial direction of the hollow cylinder to form nine lens groups 321*a*. In some embodiments, a light blocking plate 353 is arranged between each two adjacent lens groups 321*a*. In some embodiments, the light blocking plate 353 is a round plate with the diameter being slightly smaller than the diameter of the hollow cylinder 35, the round plate is embedded in the cylinder body of the hollow cylinder 35 via a bolt or through clamping, the cylinder body of the hollow cylinder 35 is divided into multiple independent spaces with equal intervals, and each lens group 321*a* is arranged on an inner surface of each independent space.

In the embodiment 2, the light source 31 includes a strip circuit board 311, and the strip circuit board 311 is provided with, along a length direction, at least one row of LED light groups formed by multiple LED lights which are distributed at equal intervals. The length direction of the strip circuit board 311 is in parallel with the rotating axis of the hollow cylinder 35, and the length of the hollow cylinder 35 is the same as the length of the strip circuit board 311. In some embodiments, the plane in which the strip circuit board 311 is located forms an acute angle with the plane in which the imaging plate 33 is located.

In some embodiments, a flame plate 34 is arranged in the light path of the second light group 31*b* between the hollow cylinder and the imaging plate 33. The shape and structure of the flame plate 34 are also different from those in embodiment 1. In some embodiments, the flame plate 34 is an arc plate; the flame plate 34, corresponding to the hollow cylinder, is fixed on the support frame 322; and the length of the flame plate 34 is no less than the length of the hollow cylinder. The radius of the arc plate is the same as the radius of a cylinder body of the hollow cylinder 35, the length of the arc plate is no less than the length of the hollow cylinder 35, and the arc plate can coat the outside of the hollow cylinder 35. Moreover, one of the two long sides of the arc plate is fixed on the imaging plate 33 via bolts, and two ends are respectively fixed on the top parts of two support frames 322 via bolts, therefore, the arc plate is erected outside the hollow cylinder 35 in a fixed manner, and will not rotate along with the rotation of the hollow cylinder. In some embodiments, the flame plate 34 is provided with multiple light-transmitting holes 341, and the light-transmitting holes 341 are flame shaped. After being shaped via the flame-shaped light-transmitting holes 341, the generated second light group 31*b* can be projected onto the imaging plate 33 to show flame shaped light spots.

In the embodiment 2, the process and principle of simulating generation of flames are the same as those in embodiment 1, both utilizing the first light group 31*a* emitted by the light source to penetrate twice the convex lenses on the light-transmitting rotating body to form the second light group 31*b*. Since the distances between each convex lens and the imaging plate are different, the finally formed light spots are also different in shapes, brightness and positions.

Embodiment 3

Figure 11:
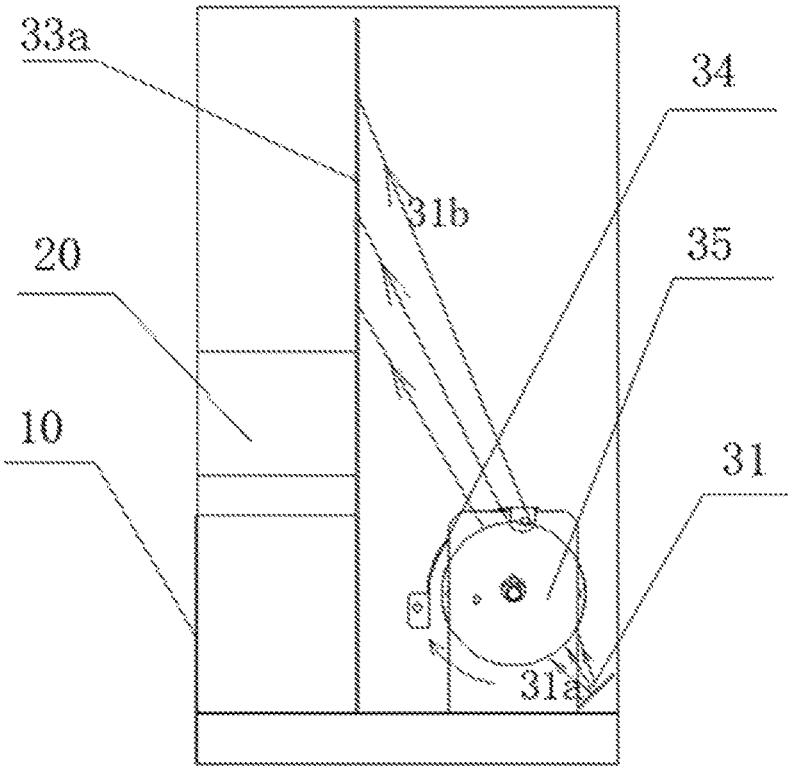
FIG. 11 is an overall structural schematic diagram of another simulated electric fireplace of embodiment 2.
Figure 12:
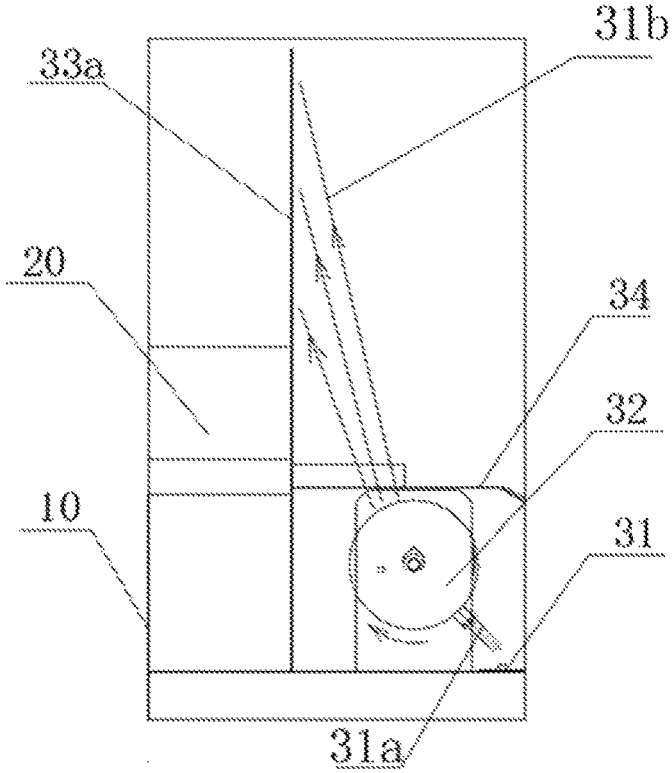
FIG. 12 is an overall structural schematic diagram of another simulated electric fireplace of embodiment 1.

Please refer to FIG. 11 and FIG. 12, the main structure of the simulated electric fireplace in the embodiment 3 can be the same as the structure in embodiment 1 or embodiment 2, and the simulated electric fireplace in embodiment 3 merely differs in the arranged positions and structures of the imaging plate. In the embodiment 3, the imaging plate is a light-transmitting plate 33*a*. The light-transmitting plate 33*a* is arranged between the simulated fuels 20 and the light-transmitting rotators, and is arranged in the middle of the shell 10 behind the simulated fuel 20. In some embodiments, the light-transmitting plate 33*a* is a semi-transparent plate.

When using, the first light group emitted by the light source after being energized irradiates on the light-transmitting rotator which rotates along with a motor, penetrates twice through the convex lenses on the light-transmitting rotator 32 to form the second light group 31*b* with changing angles, and finally projects to the light-transmitting plate in the middle of the shell to form light spots. Since the angle of each convex lens and the distance between each convex lens and the rear shell plate are different, the formed light spots are changed in shapes, brightness and positions, thereby showing an effect of flame fading and flaring and sparkle fluttering on the light-transmitting plate.

Compared with the conventional art, in the embodiments, a light source is arranged outside a light-transmitting rotator, a first light group emitted by a light source penetrates through a light-transmitting rotator provided with light concentrating blocks to convert into a second light group, and then projects onto an imaging plate to form light spots. Since the light-transmitting rotator makes rotary movement, the first light group and the condensing blocks make relative movement, such that refraction angles and/or reflection angles of the lights in the second light group change constantly, moreover, the distance between the focus of the light concentrating block and any arbitrary position on the imaging plate is different, such that the light spots, formed by the second light group at different positions on the imaging plate, have different brightness and sizes, and finally, the light spots, formed when the second light group irradiates onto the imaging plate, change in shapes, positions and brightness, thereby being capable of simulating an effect of flame fading, flaring and fluttering, and improving sense of reality and three-dimensional sense of combustion of simulated fuels. In addition, in embodiments of the present invention, a light source is arranged outside the light-transmitting rotator, thereby being beneficial for heat dissipation of the light source, and facilitating replacement; meanwhile, the distance between the light source and the light-transmitting rotator can be adjusted flexibly with no limitations, so as to obtain the best effect of flame fluttering visually.

Embodiments 4

The main structure of the simulated electric fireplace in the embodiment 4 can be the same as the structure in embodiment 1, embodiment 2 or embodiment 3, and the simulated electric fireplace in embodiment 4 merely differs in replacing the light-transmitting rotators in the flame simulating device with light-transmitting means or light-transmitter. The flame simulating device in the embodiment 4 includes a light source, rotatable light-transmitting means or light-transmitter and an imaging plate, and the light source emits a first light group; the first light group passes through the light-transmitting means or light transmitter and forms a second light group, the second light group projects on the imaging plate and forms images.

The light-transmitting means or light transmitter can be a symmetrical or asymmetric structure. In some embodiments, the light-transmitting means or light transmitter are rotating bodies, the bus of each light-transmitting mean is an arc, the shape of each rotator is formed by a closed surface, the closed surface is formed by rotating the bus around an axis, the axis is a line connecting two ends of the bus or another line paralleling with the connecting line between two ends of the bus.

Figure 13:
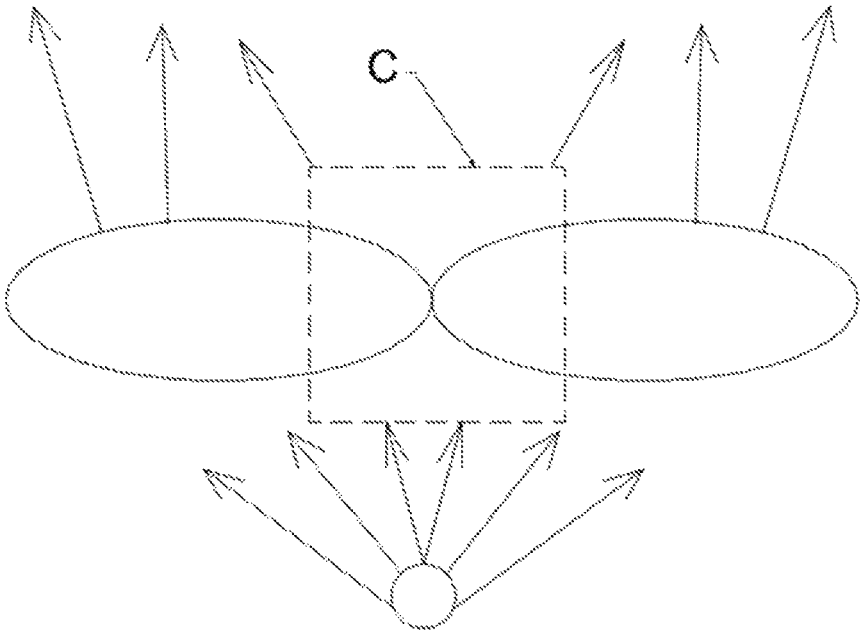
FIG. 13 is an optical path diagram of two convex lenses in some embodiments.
Figure 14:
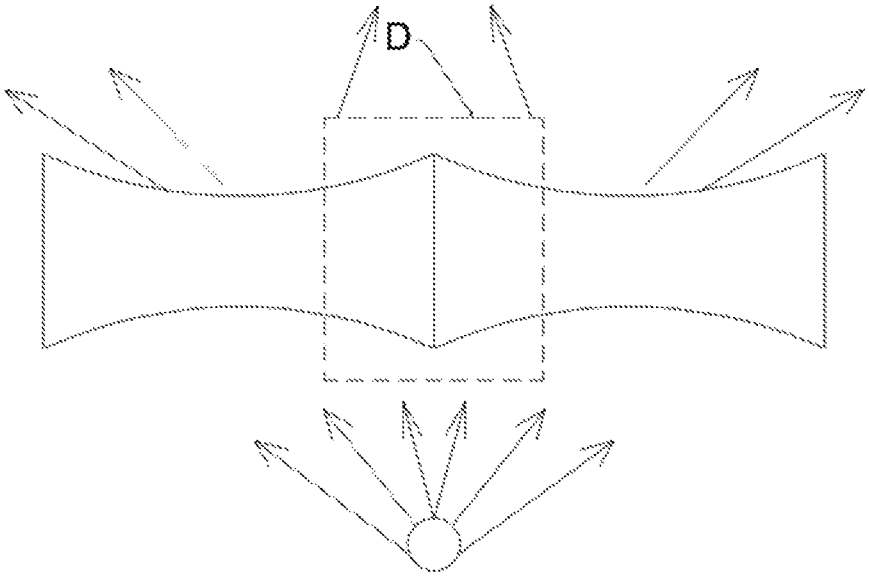
FIG. 14 is an optical path diagram of two concave lenses in some embodiments.

In the embodiment 1, the light concentrating blocks arranged on the light-transmitting rotators are convex lenses, in fact, please refer to FIG. 13, when connecting two convex lenses, the connector C of two convex lenses forms a concave lens. If concave lenses are arranged on the light-transmitting means or light transmitter, please refer to FIG. 14, the connector D of each two concave lenses will form a convex lens, and the convex lens can condense light. Therefore, in some embodiments, the concave lenses or the mixture of concave lenses and convex lenses can be arranged on the light-transmitting means or light transmitter, and lights reflect, refract, condense and diverge between the concave lenses and/or convex lenses. And it can be defined that, in the embodiment 4, the concave lenses, convex lenses or the mixture of concave lenses and convex lenses arranged on the light-transmitting means or light transmitter are light mixing blocks.

The light-transmitting means or light transmitter can be hollow or solid. When the light-transmitting means or light transmitter are hollow, the light mixing blocks are arranged at the inner or outer surfaces of the light-transmitting means or light transmitter. When the light-transmitting means or light transmitter are solid, the light mixing blocks are arranged at the outer surfaces of the light-transmitting means or light transmitter. Some of the light mixing blocks are closely arranged to be in a circle along the circumferential direction of the light-transmitting means or light transmitter, and the circles of light concentrating blocks are closely arranged along the axial direction of the light-transmitting means or light transmitter. When a first light group emitted by the light source passes through the light mixing blocks, the lights in the first light group reflect, refract, condense and diverge, so that the lights in the first light group form a second light group interwoven by multiple lights with different light paths. Therefore, when the light-transmitting means or light transmitter rotate, a fading and flaring simulated flame can be observed at the imaging plate.

In some embodiments, the light source includes at least one LED array, each of the LED arrays is formed by several LED lights, and the LED lights are arranged in a row equidistantly; each of the LED arrays is arranged along the axial direction of the light-transmitting rotators, and is arranged in front of one of the light-transmitting rotators.

In some embodiments, the flame simulating device includes at least two light-transmitting means or light transmitter which are arranged coaxially, and each two light-transmitting means or light transmitter are connected via a connector. The connectors can be opaque or transparent, the opaque connectors include frosted surfaces and the transparent connectors are of transparent plastic material.

When using, the first light group passes through the light-transmitting means or light transmitter and the light mixing blocks and convert into the second light group after the lights in the first light group reflect, refract, condense and diverge. The second light group forms light spots with different brightness on the imaging plate. Since the positions of each light mixing block arranged on the light-transmitting means or light transmitter are different, and the distance between the light mixing blocks and the imaging plate are different, when rotating the light-transmitting means or light transmitter, the shapes, positions and brightness of the light spots are changing, a fading, flaring and fluttering simulated flame can be observed at the imaging plate.

Although the present invention has been disclosed in the form of preferred embodiments and variations thereon, it will be understood that numerous additional modifications and variations could be made thereto without departing from the scope of the invention.

For the sake of clarity, it is to be understood that the use of 'a' or 'an' throughout this application does not exclude a plurality, and 'comprising' does not exclude other steps or elements.

What is claimed:

1. A flame simulating device comprising:

a light source emitting a first light group;

at least one light-transmitting rotator arranged in a light path of the first light group in a rotatable manner, each of the light-transmitting rotators is provided with light concentrating blocks, the light concentrating blocks convert the first light group into a second light group;

an imaging plate is arranged in the light path of the second light group;

wherein some of the light concentrating blocks are arranged to be in a circle along a circumferential direction of the light-transmitting rotators, and circles of the light concentrating blocks are arranged along an axial direction of the light-transmitting rotators, and some opaque components are arranged between two or more adjacent circles of the light concentrating blocks.

2. The flame simulating device of claim 1, wherein each of the light-transmitting rotators is a hollow sphere.

3. The flame simulating device of claim 2, wherein the light-transmitting rotators are arranged coaxially, and two light-transmitting rotators are connected via the opaque component.

4. The flame simulating device of claim 2, wherein the light source comprises at least one LED array, each of the LED arrays is formed by several LED lights, and the LED lights are arranged in a row equidistantly; each of the LED arrays is arranged along the axial direction of the light-transmitting rotators, and is arranged in front of one of the light-transmitting rotators.

5. The flame simulating device of claim 4, wherein the flame simulating device comprises three light-transmitting rotators, and the LED array corresponding to the light-transmitting rotator in the middle comprises blue LED lights and orange LED lights.

6. The flame simulating device of claim 5, wherein the flame simulating device comprises a motor, the motor drives the light-transmitting rotator to rotate.

7. The flame simulating device of claim 4, wherein the flame simulating device comprises a flame plate, the flame plate is provided with light-transmitting holes, and is arranged in the light path of the second light group between the light-transmitting rotators and the imaging plate; the second light group emitted from the light-transmitting rotators and projects on the imaging plate through the light transmitting hole of the flame plate.

8. The flame simulating device of claim 1, wherein each of the light-transmitting rotators is a cylinder.

9. The flame simulating device of claim 8, wherein the opaque component is arranged between each two adjacent circles of light concentrating blocks, and the opaque component is a light blocking plate.

10. A simulated electric fireplace comprises a shell, a front side of the shell is provided with a window, wherein an inner cavity of the shell is provided with the flame simulating device of claim 1.

11. A flame simulating device comprising:

a light source, rotatable light-transmitters and an imaging plate, wherein the light source emits a first light group;

wherein the first light group passes through the light-transmitters and forms a second light group, the second light group projects on the imaging plate and forms images;

wherein each of the rotatable light-transmitters comprises several light mixing blocks, the first light group passes through the rotatable light-transmitters and the light mixing blocks to form the second light group;

wherein some of the light mixing blocks are arranged in a circle along a circumferential direction of the light-transmitter, and the circles of light concentrating blocks are arranged along the axial direction of the light-transmitter;

wherein some opaque components are arranged between two or more adjacent circles of the light mixing blocks.

12. The flame simulating device of claim 11, wherein the light mixing blocks are selected from a group consisting of convex lenses, concave lenses and a combination of convex lenses and concave lenses.

13. The flame simulating device of claim 11, wherein the light-transmitter are selected from the group consisting of cylinders and rotators; a bus of each rotator is an arc, and the shape of each rotator is formed by rotating the bus around an axis.

14. The flame simulating device of claim 13, wherein the flame simulating device comprises at least two light-transmitter which are arranged coaxially, and each two light-transmitters are connected via a connector, the axis of the light-transmitter penetrate the connector, the light-transmitter and the connectors can rotate around the axis.

15. The flame simulating device of claim 13, wherein the light-transmitter are hollow, the light mixing blocks are arranged at the inner or outer surfaces of the light-transmitter; or the light-transmitter are solid, the light mixing blocks are arranged at the outer surfaces of the light-transmitter.

16. The flame simulating device of claim 15, wherein the light source comprises at least one LED array, each of the LED arrays is formed by several LED lights, and the LED lights are arranged in a row equidistantly; each of the LED arrays is arranged along the axial direction of the light-transmitting rotators, and is arranged in front of one of the light-transmitting rotators.

17. The flame simulating device of claim 16, wherein the flame simulating device comprises a motor, the motor drives the light-transmitter to rotate.

* * * * *